US007246565B2

(12) United States Patent
Snook et al.

(10) Patent No.: US 7,246,565 B2
(45) Date of Patent: Jul. 24, 2007

(54) BOAT HULL DISPERSION TUNNEL ENGAGEMENT DEVICE AND METHOD

(75) Inventors: William N. Snook, Orlando, FL (US); William F. Waits, Jr., Oviedo, FL (US)

(73) Assignee: Correct Craft, Inc., Orlando, FL (US)

( * ) Notice: Subject to any disclaimer, the term of this patent is extended or adjusted under 35 U.S.C. 154(b) by 0 days.

(21) Appl. No.: 11/267,020

(22) Filed: Nov. 4, 2005

(65) Prior Publication Data

US 2006/0096515 A1 May 11, 2006

Related U.S. Application Data

(60) Provisional application No. 60/624,923, filed on Nov. 4, 2004.

(51) Int. Cl.
*B63B 1/32* (2006.01)

(52) U.S. Cl. ..... 114/288; 114/284

(58) Field of Classification Search ..... 114/280, 114/271, 284, 285, 288, 289, 290, 291; 440/43
See application file for complete search history.

(56) References Cited

U.S. PATENT DOCUMENTS

| | | | | |
|---|---|---|---|---|
| 2,914,019 | A | 11/1959 | Gewin | |
| 3,603,277 | A | 9/1971 | Manary | |
| 3,633,531 | A | 1/1972 | Hayes | |
| 4,549,498 | A | 10/1985 | Meyer et al. | |
| 4,862,817 | A * | 9/1989 | Hornsby et al. | 114/288 |
| 4,909,175 | A * | 3/1990 | Arnseson | 114/285 |
| 4,977,845 | A * | 12/1990 | Rundquist | 114/289 |
| 4,989,534 | A * | 2/1991 | Field | 114/289 |
| 5,390,623 | A | 2/1995 | Mackaness | |
| 5,549,071 | A | 8/1996 | Pigeon et al. | |
| 5,628,272 | A * | 5/1997 | Thomas | 114/285 |
| 5,988,091 | A | 11/1999 | Willis | |
| 6,012,408 | A | 1/2000 | Castillo | |
| 6,138,601 | A | 10/2000 | Anderson et al. | |
| 6,293,216 | B1 * | 9/2001 | Barsumian | 114/289 |
| 6,293,218 | B1 * | 9/2001 | White | 114/288 |
| 6,427,616 | B1 | 8/2002 | Hagen | |
| 6,691,634 | B2 | 2/2004 | Fritchle | |
| 6,874,441 | B2 | 4/2005 | Pigeon | |
| 6,923,136 | B1 | 8/2005 | D'Alessandro | |
| 6,923,137 | B2 | 8/2005 | Waits, Jr. | |
| 6,941,884 | B2 | 9/2005 | Moore | |
| 2005/0155540 | A1 | 7/2005 | Moore | |
| 2005/0247252 | A1 * | 11/2005 | Brown | 114/288 |
| 2006/0162639 | A1 * | 7/2006 | Costello | 114/284 |

* cited by examiner

*Primary Examiner*—Lars A. Olson
(74) *Attorney, Agent, or Firm*—Allen, Dyer, Doppelt, Milbrath & Gilchrist, P.A.

(57) ABSTRACT

A boat hull includes a dispersion tunnel extending fore and aft forming a channel within a hull bottom surface for receiving a flow of water. A gate is inserted into and out of the channel for affecting pressure on the hull bottom with movement between open and closed positions, wherein the gate is out of the channel and fully extended into the channel. By altering the depth of the gate into the channel, hull performance and wake shape are modified as desired.

21 Claims, 8 Drawing Sheets

BOAT HULL DISPERSION TUNNEL ENGAGEMENT DEVICE AND METHOD

CROSS-REFERENCE TO RELATED APPLICATIONS

This application claims the benefit of U.S. Provisional Application No. 60/624,923, filed Nov. 4, 2004, for "Boat Hull Dispersion Tunnel Engagement Device and Method," the disclosure of which is hereby incorporated by reference herein in its entirety, and all commonly owned.

FIELD OF THE INVENTION

The present invention generally relates to boat hulls, and in particular to a performance boat hull operable for controlling a wake useful in performing water sports skills.

BACKGROUND OF THE INVENTION

A towboat used in water sports such as wake boarding and water skiing must provide a wake having a shape desirable for various events for the wake boarder or the skier. By way of example, the slalom skier may prefer a soft wake having narrow crests, a shallow trough and a low wake height. Further, the slalom skier may prefer a particular location of a rooster tail as well as a rooster tail that may be considered small and soft. In contrast, a wake boarder may desire a wider crest and no trough, if at all possible. Depending on the wake boarder's personal preference, a specific ramp angle of the wake may be desired as well as a particular lip shape. A high wake height is generally desirable at the typical towrope length ranges being used.

To avoid the expense associated with purchasing and owning more then one boat, there is a need to provide a performance boat hull that can provide a desirable wake for the slalom skier to the wake boarder both at a professional and amateur level. By providing a single boat hull that can vary the shape of its wake, a skier, a slalom skier, and a wake boarder, whether amateur or professional may find a desired wake shape from a single boat hull.

SUMMARY OF THE INVENTION

Embodiments of the present invention are directed to boat performance and resulting wake control through a modifying of water flowing across the hull and pressure on the hull bottom surface. In keeping with the teachings of the present invention, a boat having a hull with a keel extending fore and aft may include a dispersion tunnel extending fore and aft and extending along or generally parallel to the keel. The dispersion tunnel includes a channel within a hull bottom surface for receiving a flow of water as the boat hull is operated within a body of the water. The channel may be defined as having an entrance portion positioned forward an exit portion. A gate is operable with the hull and positioned for operation with the dispersion tunnel with movement from an open position, wherein the gate is out of the channel, to a closed position, wherein the gate is fully extended into the channel, positions therebetween.

The channel may comprise a length dimension extending longitudinally fore and aft of the hull, a transverse width dimension generally perpendicular to the keel, and a depth dimension extending into the hull. The length dimension may be substantially greater than the width dimension and the width dimension may be substantially greater than the depth dimension. Movement of the gate may be described as being within a plane generally perpendicular to a hull bottom surface forming a bottom surface of the channel. Further, a primary surface of the gate may be perpendicular to the centerline or keel of the hull or alternatively may be skewed at an angle other than ninety degrees to the keel line.

As will come to the mind of those skilled in the art once having the benefit of the teachings of the present invention, various combinations of the dispersion tunnel and gate may be employed depending on an affect to be achieved. By way of example, the gate may be positioned at one of a forward location of the channel, an aft location of the channel, and a central location of the channel. A first gate may be positioned for operation at a forward location of the channel and a second gate may be positioned at one of an aft location and a central location of the channel. In other words, a plurality of gates may be operable within the channel.

The dispersion tunnel may be positioned such that the entrance portion of the channel is positioned aft amidships or aft a center of gravity of the boat with the exit portion extending aft through the transom or alternatively proximate the transom. Alternatively, the dispersion tunnel may comprise the channel having the entrance portion positioned forward amidships or a center of gravity of the boat with the exit portion extending aft through the transom or proximate the transom. Yet further, the dispersion tunnel may comprise the channel having the entrance portion positioned forward amidships or forward a center of gravity of the boat with the exit portion extending aft amidships or the center of gravity. Depending on an effect to be achieved with regard to the performance of the boat, the dispersion tunnel may have the channel entrance and exit portions forward amidships or the center of gravity with the entrance portion and the exit portion aft amidships or the center of gravity. In various combinations, and as will come to the mind of those skilled in the art having the benefit of the teachings of the present invention, there may be a plurality of dispersion tunnels with one dispersion tunnel including the channel entrance portion and the exit portion forward a center of gravity of the boat, and a second dispersion tunnel including the channel entrance portion and the exit portion aft the center of gravity. Yet further, a first dispersion tunnel may be positioned on a starboard portion of the hull, and a second dispersion tunnel positioned on a port side of the hull opposing the first dispersion tunnel.

As will be detailed later in this specification, the gate may comprise a plate having a transverse dimension for transversely extending fully across the channel during partially and fully inserted positions of the gate therein. For operating the gate, a base may be mounted to the hull with a lever arm pivotally connected to the base at an axis of rotation. The lever arm first end may be rotatably connected to the gate. A drive arm may be mounted to a second end of the lever arm opposing the first end for movement of the first end about the axis, and thus movement of the gate. The movement of the gate may be within a plane generally perpendicular to a hull bottom surface forming a bottom surface of the channel. A gate controller may be operable with the drive arm for a controlled movement of the gate between the open position and the closed position. In a manual embodiment, the gate controller may comprise a handle mounted for operation by an operator of the boat with a connection between the handle and the drive arm. Manual or power driven controllers may be employed as desired. The base may be mounted internally to the hull or on a transom of the boat.

BRIEF DESCRIPTION OF THE DRAWINGS AND PHOTOGRAPHS

Features and benefits of the present invention will become apparent as the description proceeds when taken in conjunction with the accompanying drawings and photos in which.

Figure 1:
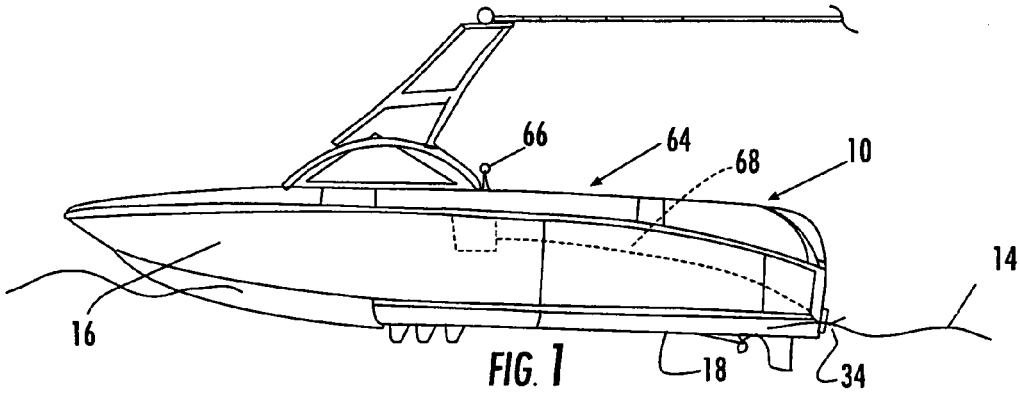
FIG. 1 is a side elevation view of a performance tow boat having a tow point at a desired height and location relative to the hull.
Figure 16A:
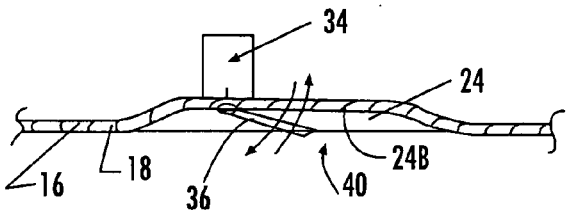
Figure 2:
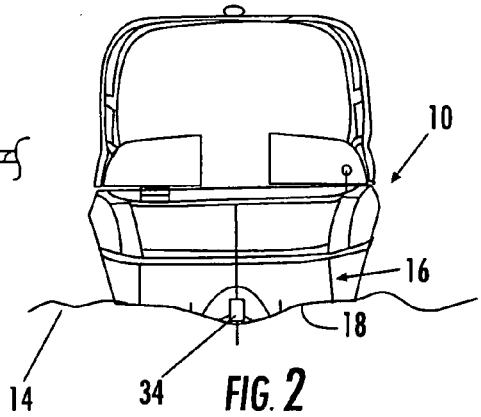
FIG. 2 is a stern elevation view of the performance boat of FIG. 1.
Figure 3:
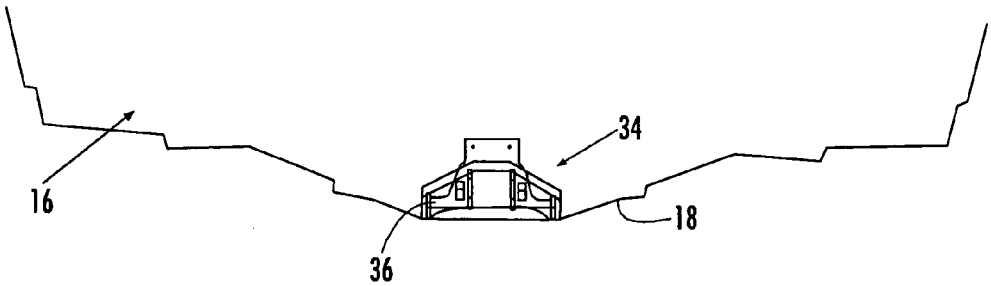
FIG. 3 is partial enlarged rear (stern) view of a transom and hull having a center dispersion tunnel wherein a gate assembly in keeping with the teachings of the present.
Figure 19:
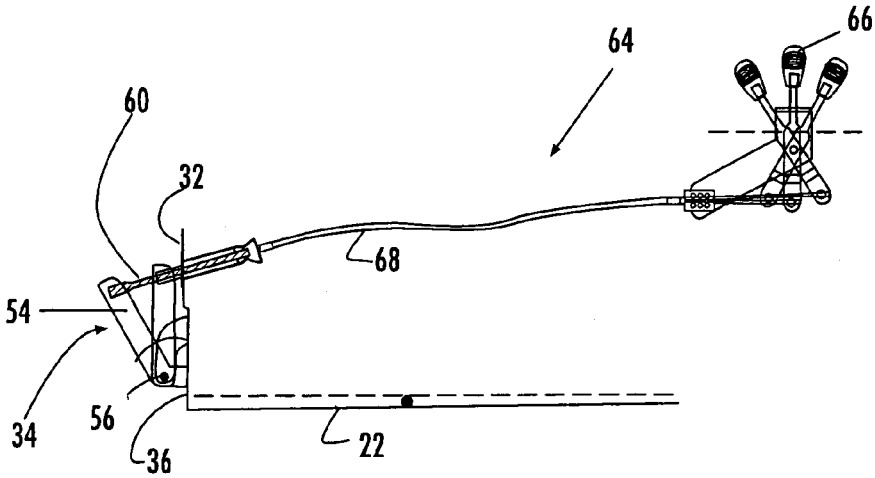
Figure 13:
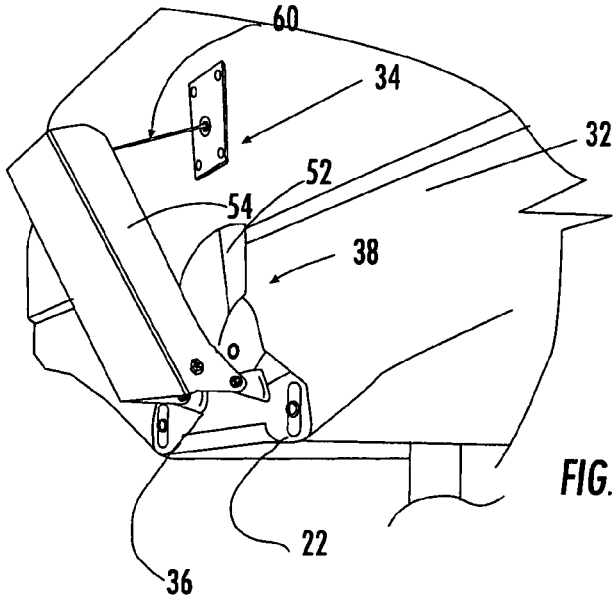
Figure 14:
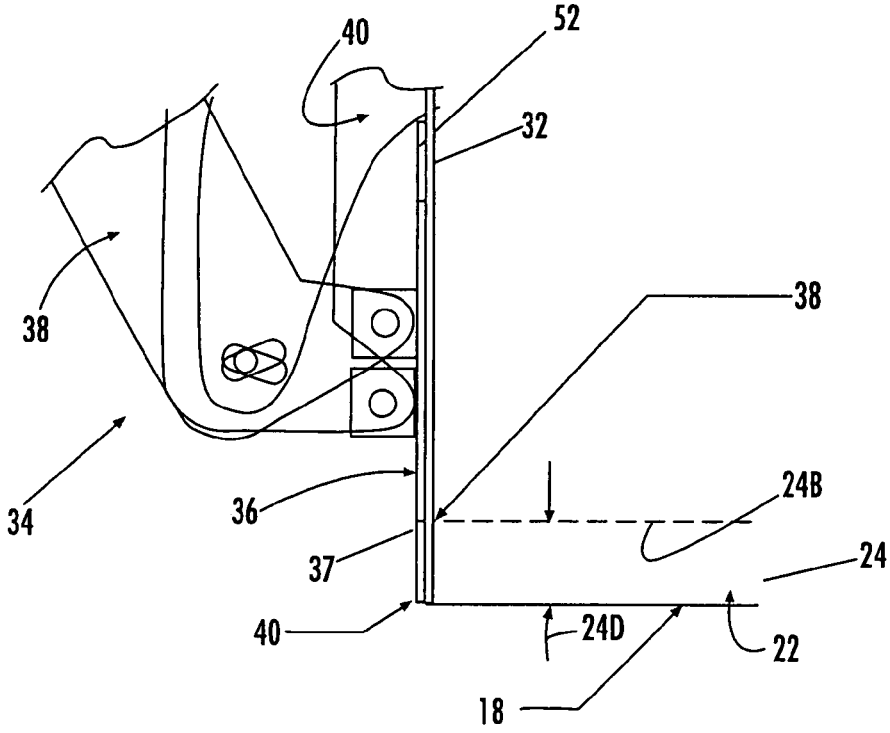
Figure 15:
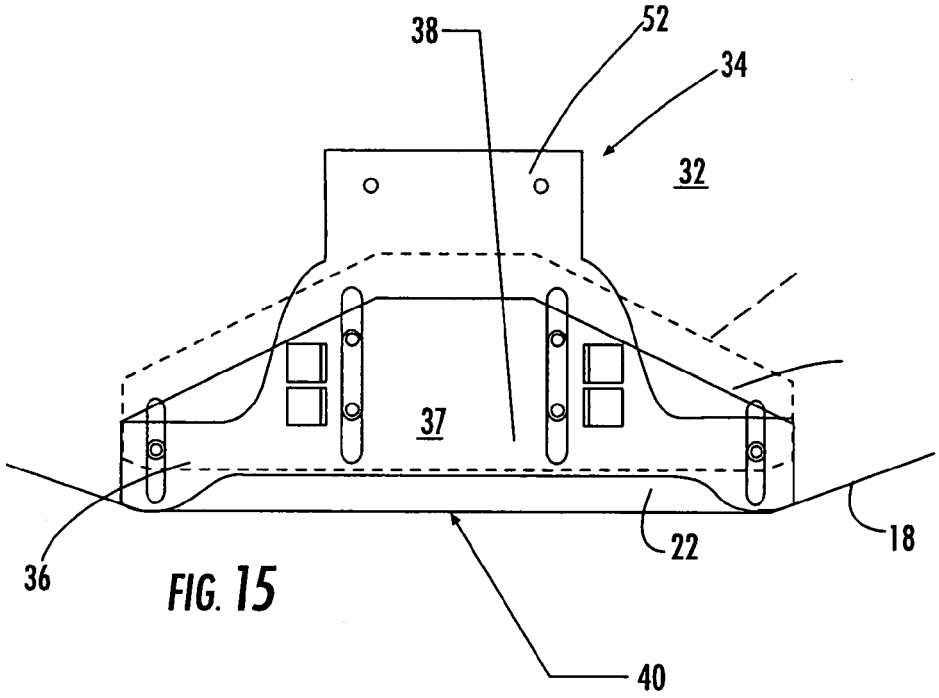
Figure 18:
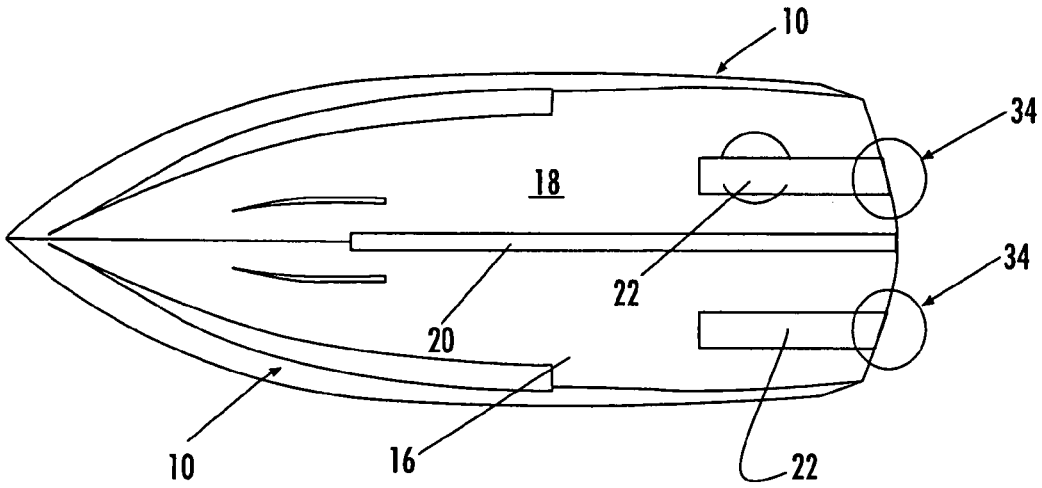
Figure 17:
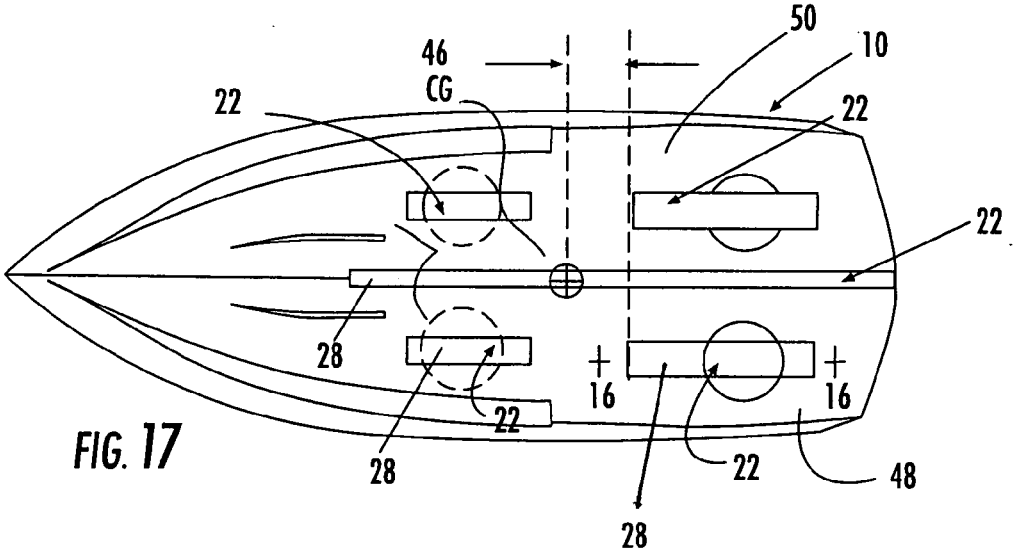
Figure 16:
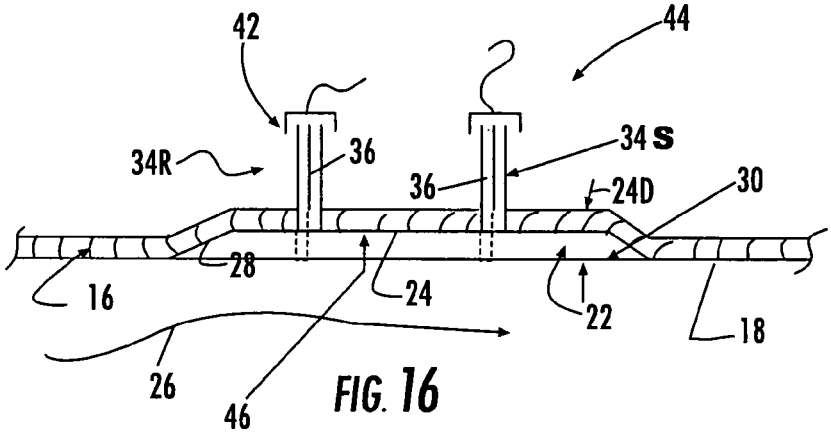
Figure 20:
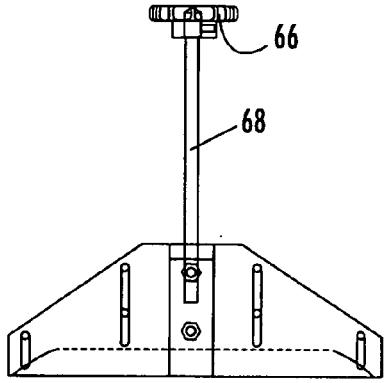
Figure 21:
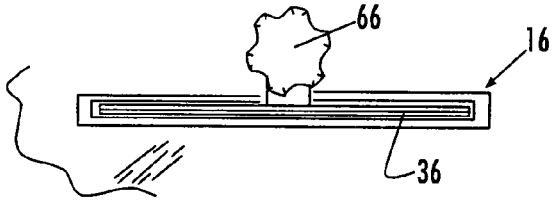
Figure 22:
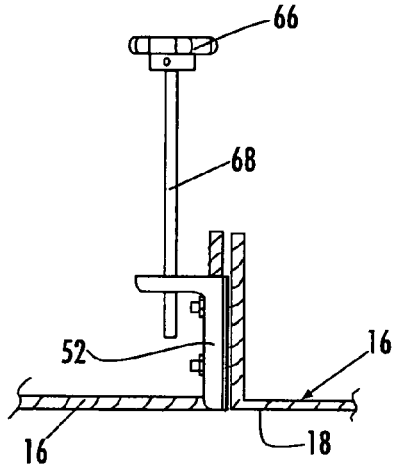
Figure 23:
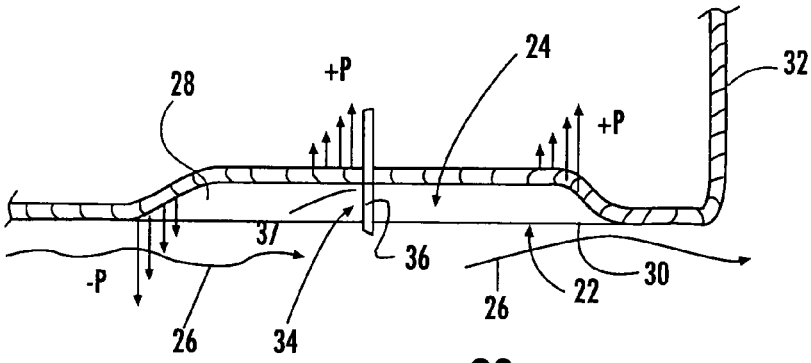

FIG. 13 a side perspective view of the gate assembly in a fully disengaged position wherein water flow exits the dispersion tunnel without interference by the gate;

FIGS. 14 and 15 are partial side elevation and front views of one gate assembly herein described by way of example;

FIG. 16 a partial diagrammatical cross section view, taken through lines 16-16 of FIG. 17, illustrating multiple gate assemblies within center portions of a dispersion tunnel;

FIG. 16A is a partial diagrammatical view illustrating an alternate embodiment of a gate assembly for rotatably engaging a plate with a channel of a dispersion tunnel;

FIGS. 17 and 18 are bottom plan views of boat hulls illustrating various locations and shapes for dispersion tunnels, which tunnels may have various locations therein;

FIG. 19 is a partial view of a gate assembly operable by a manual controller;

FIG. 20 is an elevation view of an alternate embodiment of a gate assembly;

FIGS. 21 and 22 are partial top and elevation views illustrating the embodiment of FIG. 20 used in a through the hull arrangement for having a plate access a channel of a dispersion tunnel; and FIG. 23 is a diagrammatical elevation view illustrating pressure changes on a hull bottom surface resulting from entrance and exit portions of the channel of a dispersion tunnel and as a result of a gate assembly portable with the dispersion tunnel.

DETAILED DESCRIPTION OF THE PREFERRED EMBODIMENTS

The present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and fully convey the scope of the invention to those skilled in the art. Like numbers refer to like elements throughout.

Figure 8:
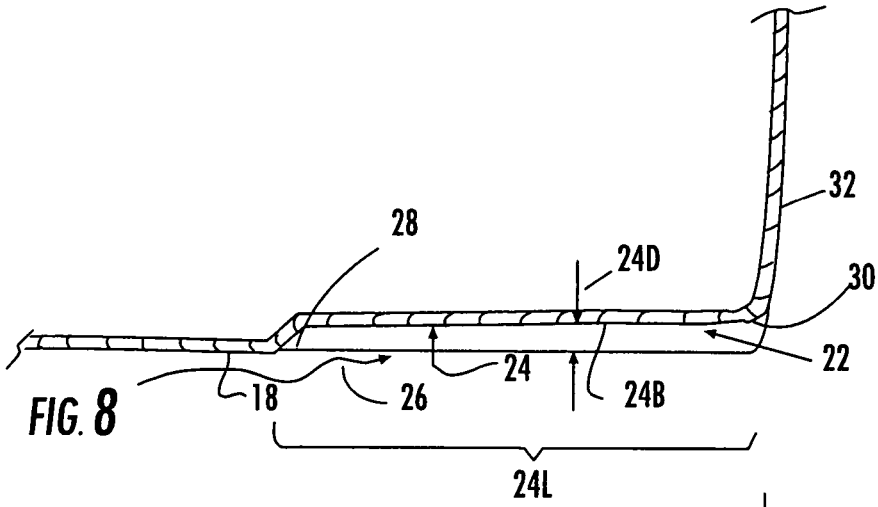
FIG. 8 is a partial diagrammatical cross-section view taken through lines 8-8 of FIG. 7.
Figure 9:
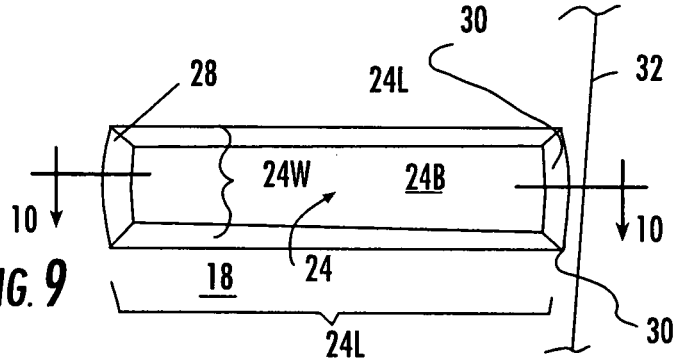
FIG. 9 is a perspective view of an alternate embodiment of a dispersion tunnel.
Figure 10:
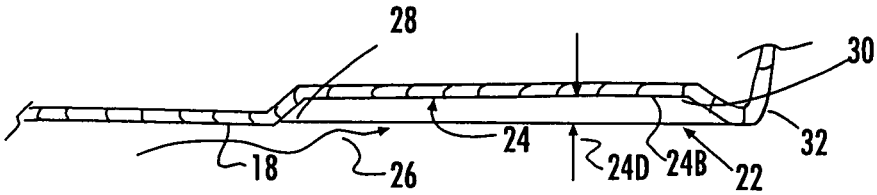
FIG. 10 is a partial diagrammatical cross-section view taken through lines 10-10 of FIG. 9.

Referring initially to FIGS. 1-5, embodiments of the present invention are directed to performance of a boat 10 and resulting control of a wake 12 through a modifying of water 14 flowing across a hull 16 and pressure effects on a hull bottom surface 18. In keeping with the teachings of the present invention, the boat 10 is herein described as having the hull 16 with a keel 20 extending fore and aft. As illustrated with reference to FIG. 6, one embodiment of the present invention includes a dispersion tunnel 22 extending fore and aft along the keel 20. As illustrated with reference to FIGS. 7 and 8, in one embodiment the dispersion tunnel 22 includes a channel 24 penetrating into the hull bottom surface 18 for receiving a flow of water 26 as the boat hull 16 is operated within the body of water 14. The channel 24 may be defined as having an entrance portion 28 positioned forward an exit portion 30. As illustrated by way of example with reference to FIGS. 7-10, the channel 24 may extend through a transom 32. With reference again to FIGS. 9 and 10, by way of example, the channel 24 will herein be described as comprising a length 24L extending longitudinally fore and aft of the hull 16, a transverse width 24W generally perpendicular to the keel 20, and a depth 24D extending into the hull bottom surface 18. The length 24L is substantially greater than the width 24W and the width substantially greater than the depth 24D. It is expected that alternate tunnel shapes will come to the mind of those skilled in the art now having the benefit of the teachings of the present invention. Further, the bottom surface 24B may have surface shapes including flat, elliptical, and prism-like, by way of example. The entrance and exit portions 28, 30 may be sharp or smooth with a desired radius for a transition into and out of the channel 24.

Figure 11:
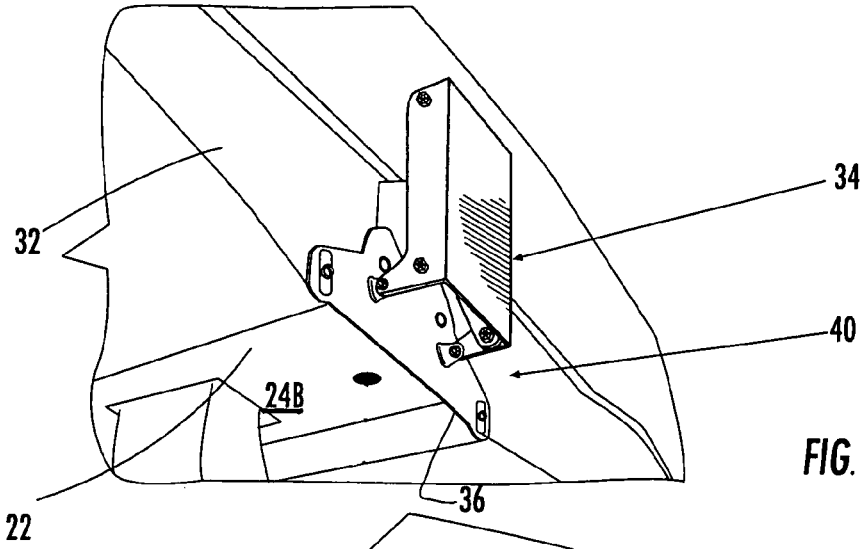
FIGS. 11 and 12 are perspective views of a gate assembly illustrating the gate assembly in an engaged position.
Figure 12:
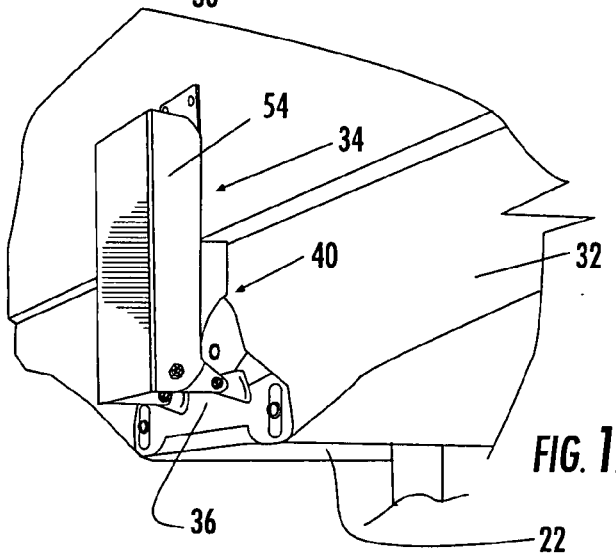

As illustrated with reference again to FIGS. 3, 6, 14, and 15, by way of example, a gate assembly 34 includes a plate 36 operable with the hull 16 and positioned for operation with the dispersion tunnel 22 with movement from an open position 38, wherein the gate is disengaged and out of the channel 24, to a closed position 40, with the plate 36 engaged and fully extended into the channel 24, and positioned therebetween, as illustrated with reference to FIGS. 11-15. While the above embodiments illustrate the gate assembly 34 operable at the transom 32, alternate locations for operation with the dispersion tunnel 22 are appropriate as will be further detailed later in this section. The plate 36 includes a transverse dimension for transversely extending fully across the channel 28 during partially and fully inserted positions of the plate.

Movement of the plate 36 may be described as being within a plane generally perpendicular to a hull bottom surface 18 forming a bottom surface 24B of the channel. Further, a primary surface 37 of the plate 36 may be perpendicular to the centerline or keel 20 of the hull 16 or alternatively may be skewed 36S at an angle other than ninety degrees to the keel, as illustrated by way of example with reference again to FIG. 6.

As will come to the mind of those skilled in the art now having the benefit of the teachings of the present invention, various combinations of the dispersion tunnel 22 and the gate assembly 34 will be employed depending on an affect to be achieved. By way of example, the gate assembly 34 may be positioned at one of a forward location of the channel, an aft location of the channel, and a central location of the channel. With reference to FIG. 16, a first gate assembly 34F may be positioned for operation at a forward location 42 of the channel 24 and a second gate assembly 34S may be positioned at aft location 44 or a central location, as desired. In other words, a plurality of gate assemblies 34 may be operable within the channel 24. Alternatively, and with reference to FIG. 16A, by way of example, one of skill in the art will appreciate an embodiment including a gate assembly rotatably engaging the plate 36 with the channel 24 of the dispersion tunnel 22, now having the benefit of the teachings of the present invention.

Figure 6:
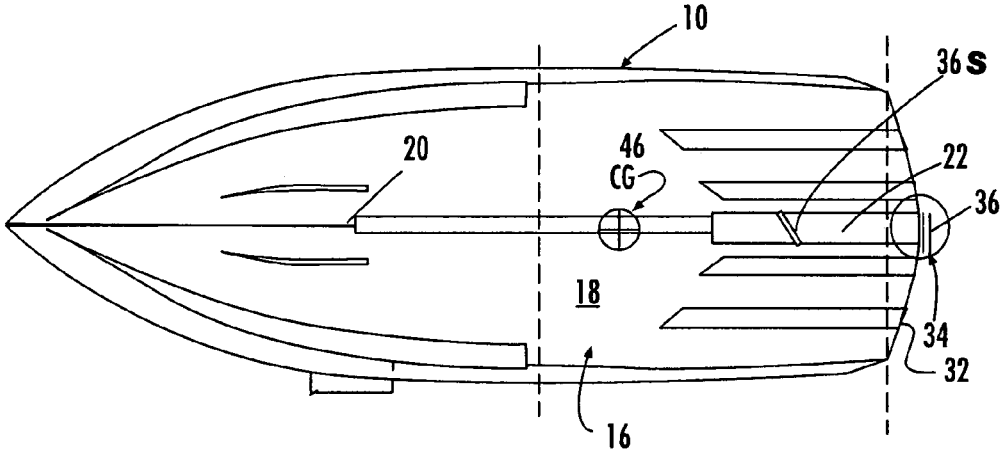
FIG. 6 is a bottom plan view of a boat hull having a center dispersion tunnel extending along a keel line thereof.
Figure 7:
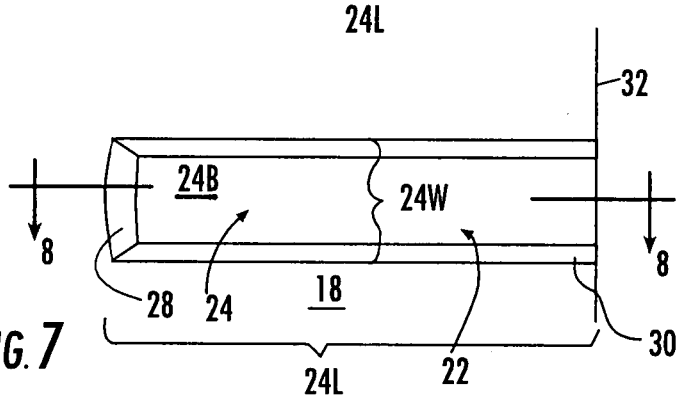
FIG. 7 is a perspective view of one embodiment of a dispersion tunnel.

Further, and as earlier addressed with reference to FIG. 6, the dispersion tunnel 22 may be positioned such that the channel entrance portion 28 is positioned aft amidships or aft a center of gravity 46 of the boat 10 with the channel exit portion 30 extending aft through the transom 34 or alternatively proximate the transom, as illustrated with reference again to FIGS. 7-10. Alternatively, the dispersion tunnel 22 may comprise the channel entrance portion 28 positioned forward amidships or the center of gravity 46 of the boat 10 with the exit portion 30 extending aft through the transom 32 or proximate the transom, as illustrated with reference to FIG. 17. Yet further, the dispersion tunnel 22 may comprise the channel entrance portion 28 positioned forward the center of gravity 46 with the exit portion 30 extending aft amidships or the center of gravity, as illustrated with reference again to FIG. 16. In various combinations, and as will come to the mind of those skilled in the art now having the benefit of the teachings of the present invention, there may be a plurality of dispersion tunnels 22 with one dispersion tunnel including the channel entrance portion and the exit portion forward a center of gravity of the boat, and a second dispersion tunnel including the channel entrance portion and the exit portion aft the center of gravity, as illustrated with reference again to FIG. 17. Yet further, a first dispersion tunnel may be positioned on a starboard portion of the hull, and a second dispersion tunnel positioned on a port side of the hull opposing the first dispersion tunnel, as illustrated with reference again to FIG. 17 and to FIG. 18.

By way of example and with reference again to FIGS. 14, 15, and to FIG. 19, in operating the gate assembly 34 a base 52 may be mounted to the hull 16 with a lever arm 54 pivotally connected to the base at an axis of rotation 56. The lever arm first end 58 is rotatably connected to the plate 36. A drive arm 60 is mounted to a second end 62 of the lever arm 54 opposing the first end 58 for movement of the first end about the axis 56, and thus movement of the plate 36. The movement of the plate is generally perpendicular to the bottom surface 24B of the channel 24. A gate controller 64 is herein described as being operable with the drive arm 60 for a controlled movement of the plate 36 between the open position 38 and the closed position 40. In a manual embodiment as illustrated with reference to FIG. 19, the gate controller 64 comprises a handle 66 mounted for operation by an operator of the boat 10 with a connection 68 between the handle and the drive arm 60. Manual or power driven controllers may be employed as desired. The base 52 may be mounted internally to the hull 16, as illustrated with reference to FIGS. 20-22 on the transom 32 as earlier described with reference to FIGS. 11-13. The gate assembly carried on the transom may be controlled manually by gate controls mounted to the sidewall of the boat generally, on the side closest to the boat operator. Alternatively, hydraulic controls may be used in lieu of cable control herein described. Yet further, a controller may automatically control the position of the gate depending on the attitude and speed of the boat, by way of example.

With regard to operation, and with reference to FIG. 23, water flow 26 through the dispersion tunnel 22 within the boat hull 16 creates pressure (P) on the hull, as illustrated with reference to FIG. 20. The gate assembly 34 embodiment of the present invention allows the pressure (P) to be controlled by the position of the plate 36 within the dispersion tunnel 22. By way of example, when the plate 36 is disengaged from the dispersion tunnel, the hull will be allowed to sit deeper in the water resulting in a "rampy" wake board wake. When the gate is engaged, lift can be created resulting in a smaller calmer, softer wake. Operation of the gate assembly 34 on the performance hull including the dispersion tunnel 22 or combinations as earlier described, allows changes in a running attitude of the boat. Depending on the position and orientation of the gate assembly 34 within the dispersion tunnel, drag may be modified. One result can be a minimizing of a porpoising effect. Further, the gate may affect the planing performance of the boat such that a fully engaged gate allows a quicker planing with less bow rise. Yet further, depending upon the location of the dispersion tunnel and gate, the gate may modify water flow from the transom changing the wake features.

As above described, the gate may be placed in areas forward and aft of the boat hulls center of gravity for modifying lift at varying attitudes. The gate assembly in these multiple and independent locations will allow the boat hull to create a dramatic change in ride angle and attitude, by way of example. The manipulation of these multiple gate assemblies will also allow use of controlling hydrodynamic forces on the boats hull to increase hull friction and drag to create a larger wake for the performer. Such a device may eliminate the need for ballast tanks or hull water ballast cells currently used for enhancing wake size and shape. Waterway use issues and lake restrictions with fat sacks and water ballast tanks may be eliminated. As above described, the plate 36 in an engaged or closed position 40 for the gate assembly 34 creates lift at varying attitudes and thus reduces dramatic drag forces and friction on the boats hull by use of higher pressure zones forward and aft of boat hull center of gravity.

By way of example, and with reference again to FIGS. 1 and 2, one embodiment of the dispersion tunnel gate was herein with reference to a boat having a performance hull such as the NAUTIQUES™ manufactured by Correct Craft, Inc. of Orlando, Fla. One location of a gate assembly as herein described by way of example with reference to FIGS. 11-15 carried on the transom of the hull channels water that has been accelerated by the propeller to create lift as well as to disperse the water in a control direction that affects the trough of a wave and its rooster tail. By way of an example of success, the hull herein described by way of example, includes the first known shift in marine hull design since single and double hull step designs/normal chines/lifting strakes, and represents the first conventional V-drive configuration approved for AWSA/U.S.A Water Ski Association.

Figure 4:
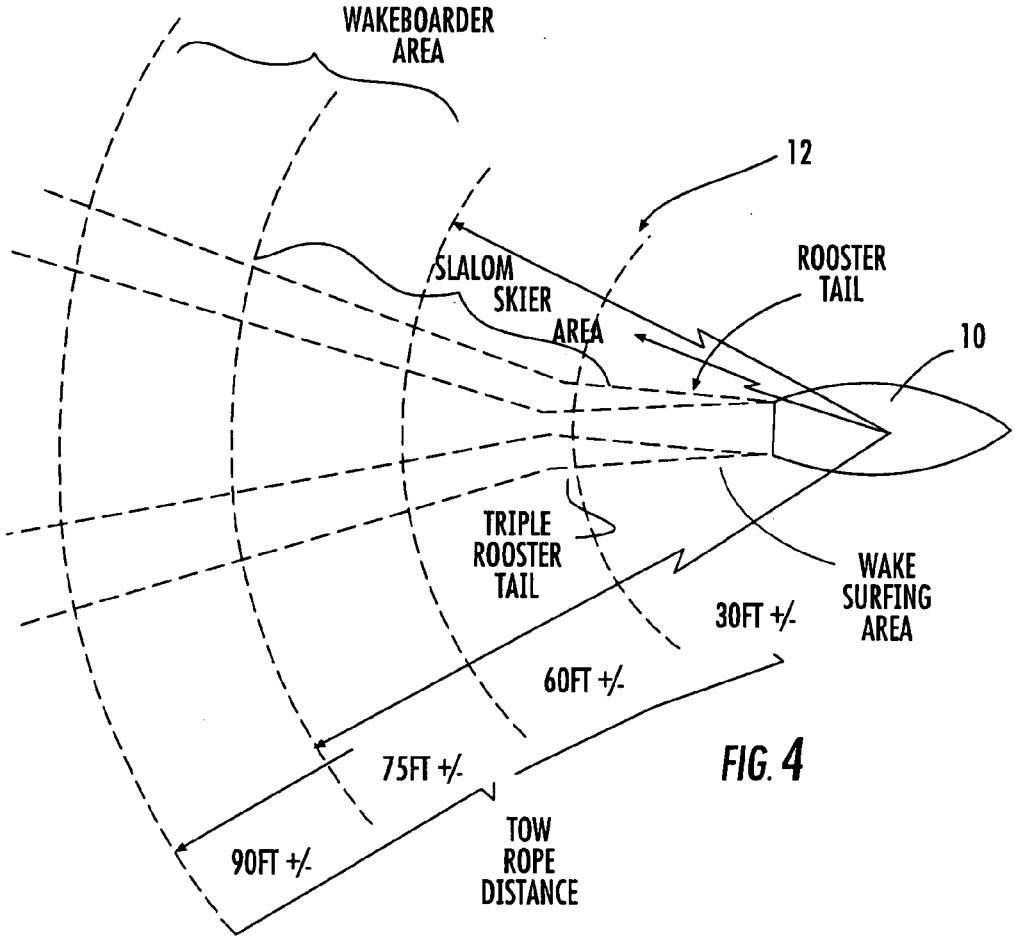
FIG. 4 is a diagrammatical plan view of a boat creating a wake having varying cross-sectional shapes depending on the tow rope distance from a tow point.
Figure 5:
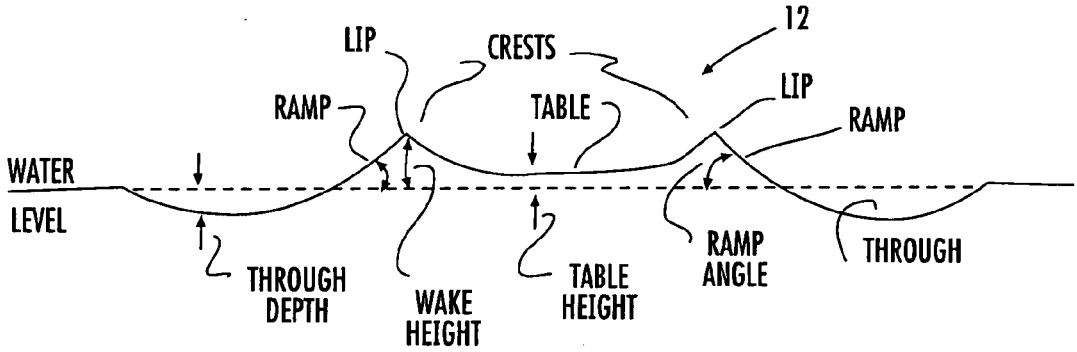
FIG. 5 is a partial cross-sectional view of a wake generally located within a wakeboarder range of the wake of FIG. 4.

As above described in FIGS. 4 and 5, the wake 12 will generally include a rooster tail and varying cross sections depending on the distance away from the boat when under way and will vary depending on the speed of the boat. Embodiments of the present invention allow the shape of the wake to be varied as desired by the various performers such as wake boarders, slalom skiers, and trick skiers. By way of example, the gate assembly 34 and dispersion tunnel 22 combination allow for a modification of the wake 12 and a desirable wake shape while changing parameters of the wake earlier described with reference to FIGS. 4 and 5. By way of example, by engaging the gate such that it extends into the dispersion tunnel, generally fully engaged to half way engaged, will provide a desired shape for a slalom skier including the shallow trough, small rooster tail, soft rooster tail, desired rooster tail position, low wake height, and a soft wake having a narrow crest. By moving the gate assembly from the fully disengaged position to a generally partially engaged position the cross section will be desirable for the wake boarder and will generally include a shallow trough, the desired wake angle and lip shape, and a wake height desired for the range or tow rope length being used by the wake boarder.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A boat comprising:

a hull having a keel extending fore and aft;

a dispersion tunnel extending fore and aft and extending along at least one of coincident with the keel and parallel and spaced from the keel, the dispersion tunnel forming a channel within a hull bottom surface for receiving a flow of water therealong as the boat hull is operated within a body of the water, the channel having an entrance portion being forward an exit portion thereof, and wherein the entrance portion is positioned aft a center of gravity of the boat and the exit portion extends aft to at least one of through a transom and proximate the transom; and a gate operable with the hull and positioned for operation with the dispersion tunnel with movement between an open position, wherein the gate is out of the channel, to a closed position, wherein the gate is fully extended into the channel.

2. A boat according to claim 1, wherein the channel comprises a length dimension extending longitudinally fore and aft of the hull, a transverse width dimension generally perpendicular to the keel, and a depth dimension extending into the hull, the length dimension substantially greater than the width dimension and the width dimension substantially greater than the depth dimension.

3. A boat according to claim 1, wherein the movement of the gate into and out of the channel is at least one of rotatable into the channel and within a plane generally perpendicular to a hull bottom surface forming a bottom surface of the channel.

4. A boat according to claim 1, wherein the gate is positioned at one of a forward location of the channel, an aft location of the channel, and a central location of the channel.

5. A boat according to claim 1, wherein the gate comprises a first gate positioned for operation at a forward location of the channel, and wherein a second gate is positioned at one of an aft location and a central location of the channel.

6. A boat according to claim 1, wherein the gate comprises a plate having a transverse dimension for transversely extending fully across the channel during partially and fully inserted positions of the gate therein.

7. A boat according to claim 1, wherein the gate extends into the channel at a non-perpendicular angle to a longitudinal axis of the channel.

8. A boat according to claim 1, wherein the gate comprises one of a plurality of gates operable within the channel.

9. A boat according to claim 1, wherein the dispersion tunnel comprises a first dispersion tunnel positioned on a starboard portion of the hull, and wherein a second dispersion tunnel is positioned on a port side of the hull opposing the first dispersion tunnel.

10. A boat comprising:

a hull having a keel extending fore and aft;

a dispersion tunnel extending fore and aft and extending along at least one of coincident with the keel and parallel and spaced from the keel, the dispersion tunnel forming a channel within a hull bottom surface for receiving a flow of water therealong as the boat hull is operated within a body of the water, the channel having an entrance portion being forward an exit portion thereof , wherein the dispersion tunnel comprises at least one of the channel having the entrance portion and the exit portion forward a center of gravity of the boat, and the entrance portion and the exit portion aft the center of gravity; and a gate operable with the hull and positioned for operation with the dispersion tunnel with movement between an open position, wherein the gate is out of the channel, to a closed position, wherein the gate is fully extended into the channel.

11. A boat comprising:

a hull having a keel extending fore and aft;

a dispersion tunnel extending fore and aft and extending along at least one of coincident with the keel and parallel and spaced from the keel, the dispersion tunnel forming a channel within a hull bottom surface for receiving a flow of water therealong as the boat hull is operated within a body of the water, the channel having an entrance portion being forward an exit portion thereof, wherein the dispersion tunnel comprises a plurality of dispersion tunnels, and wherein at least one dispersion tunnel includes the channel having the entrance portion and the exit portion forward a center of gravity of the boat, and a second dispersion tunnel includes the channel having the entrance portion and the exit portion aft the center of gravity; and a gate operable with the hull and positioned for operation with the dispersion tunnel with movement between an open position, wherein the gate is out of the channel, to a closed position, wherein the gate is fully extended into the channel.

12. A boat comprising:

a hull having a keel extending fore and aft;

a dispersion tunnel extending fore and aft and extending along at least one of coincident with the keel and parallel and spaced from the keel, the dispersion tunnel forming a channel within a hull bottom surface for receiving a flow of water therealong as the boat hull is operated within a body of the water, the channel having an entrance portion being forward an exit portion thereof; and a gate operable with the hull and positioned for operation with the dispersion tunnel with movement between an open position, wherein the gate is out of the channel, to a closed position, wherein the gate is fully extended into the channel, wherein the gate includes:

a base mounted to the hull;

a lever arm pivotally connected to the base at an axis of rotation, the lever arm having a first end rotatably connected to the gate; and a drive arm mounted to a second end of the lever arm opposing the first end for movement of the first end about the axis, and thus movement of the gate.

13. A boat according to claim 12, wherein the movement of the gate is within a plane generally perpendicular to a hull bottom surface forming a bottom surface of the channel.

14. A boat according to claim 12, further comprising a gate controller operable with the drive arm for a controlled movement of the gate between the open position and the closed position.

15. A boat according to claim 14, wherein the gate controller comprises a handle pivotally mounted forward a transom of the boat for manual operation by an operator of the boat, and a connection between the handle and the drive arm.

16. A boat according to claim 12, wherein the base is mounted on a transom of the boat.

17. A boat comprising:

a hull having a keel extending fore and aft;

a dispersion tunnel extending fore and aft generally parallel to the keel, the dispersion tunnel forming a channel within a hull bottom surface for receiving a flow of water therealong as the boat hull is operated within a body of the water, the channel having an entrance portion being forward an exit portion thereof, and wherein the channel comprises a length dimension extending longitudinally fore and aft, a transverse width dimension generally perpendicular to the keel, and a depth dimension inwardly extending, the length dimension substantially greater than the width dimension and the width dimension substantially greater than the depth dimension; and a gate operable with the hull and positioned for operation with the dispersion tunnel, the gate having a transverse dimension for transversely extending fully across the channel during partially and fully inserted positions of the gate therein, the gate operable for movement generally perpendicular to a bottom surface of the channel between an open position, wherein the gate is out of the channel for allowing a smooth flow of water therein in, to a closed position, wherein the gate is fully extended into the channel for affecting a pressure change on the hull, wherein the gate comprises a plurality of gates operable with a plurality of channels.

18. A boat comprising:

a hull having a keel extending fore and aft;

a dispersion tunnel extending fore and aft generally parallel to the keel, the dispersion tunnel forming a channel within a hull bottom surface for receiving a flow of water therealong as the boat hull is operated within a body of the water, the channel having an entrance portion being forward an exit portion thereof, and wherein the channel comprises a length dimension extending longitudinally fore and aft, a transverse width dimension generally perpendicular to the keel, and a depth dimension inwardly extending, the length dimension substantially greater than the width dimension and the width dimension substantially greater than the depth dimension, wherein the dispersion tunnel comprises a plurality of dispersion tunnels, and wherein at least one dispersion tunnel includes the channel having the entrance portion and the exit portion forward a center of gravity of the boat, and a second dispersion tunnel includes the channel having the entrance portion and the exit portion aft the center of gravity: and a gate operable with the hull and positioned for operation with the dispersion tunnel, the gate having a transverse dimension for transversely extending fully across the channel during partially and fully inserted positions of the gate therein, the gate operable for movement generally perpendicular to a bottom surface of the channel between an open position, wherein the gate is out of the channel for allowing a smooth flow of water therein in, to a closed position, wherein the gate is fully extended into the channel for affecting a pressure change on the hull.

19. A boat comprising:

a hull having a keel extending fore and aft;

a dispersion tunnel extending fore and aft generally parallel to the keel, the dispersion tunnel forming a channel within a hull bottom surface for receiving a flow of water therealong as the boat hull is operated within a body of the water, the channel having an entrance portion being forward an exit portion thereof, and wherein the channel comprises a length dimension extending longitudinally fore and aft, a transverse width dimension generally perpendicular to the keel, and a depth dimension inwardly extending, the length dimension substantially greater than the width dimension and the width dimension substantially greater than the depth dimension, wherein the dispersion tunnel comprises a first dispersion tunnel positioned on a starboard portion of the hull, and wherein a second dispersion tunnel is positioned on a port side of the hull opposing the first dispersion tunnel, and wherein each of the first and second dispersion tunnels includes at least one gate operable therewith; and a gate operable with the hull and positioned for operation with the dispersion tunnel, the gate having a transverse dimension for transversely extending fully across the channel during partially and fully inserted positions of the gate therein, the gate operable for movement generally perpendicular to a bottom surface of the channel between an open position, wherein the gate is out of the channel for allowing a smooth flow of water therein in, to a closed position, wherein the gate is fully extended into the channel for affecting a pressure change on the hull.

20. A boat according to claim 19, wherein the gate comprises a first gate positioned for operation at one location in the channel, and wherein a second gate is positioned at another location within the channel.

21. A boat according to claim 19, wherein the gate extends into the channel at a non-perpendicular angle to a longitudinal axis of the channel.

* * * * *